US010248056B2

(12) United States Patent
Hayashi et al.

(10) Patent No.: US 10,248,056 B2
(45) Date of Patent: Apr. 2, 2019

(54) FIXING DEVICE AND IMAGE FORMING APPARATUS

(71) Applicant: KYOCERA Document Solutions Inc., Osaka (JP)

(72) Inventors: Eriko Hayashi, Osaka (JP); Ryohei Tokunaga, Osaka (JP); Tatsuya Yamanaka, Osaka (JP); Takashi Kainuma, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/107,224

(22) Filed: Aug. 21, 2018

(65) Prior Publication Data

US 2019/0064713 A1 Feb. 28, 2019

(30) Foreign Application Priority Data

Aug. 22, 2017 (JP) ..... 2017-159496

(51) Int. Cl.
*G03G 15/20* (2006.01)

(52) U.S. Cl.
CPC ..... *G03G 15/2039* (2013.01)

(58) Field of Classification Search
CPC ..... G03G 15/2007; G03G 15/2053; G03G 15/2064; G03G 2215/0062; G03G 2215/2003
USPC ..... 399/38, 67, 69, 122, 320, 328, 329, 335, 399/336
See application file for complete search history.

(56) References Cited

U.S. PATENT DOCUMENTS 6,549,740 B2 4/2003 Yoneda et al.
8,600,254 B2 * 12/2013 Kinouchi ..... G03G 15/2064 399/70
8,699,918 B2 * 4/2014 Kanai ..... G03G 15/2017 399/122
8,818,254 B2 * 8/2014 Arimoto ..... G03G 15/2053 399/329
9,176,443 B2 * 11/2015 Nakayama ..... G01J 5/0853
9,557,691 B2 * 1/2017 Tokunaga ..... G03G 15/2039

FOREIGN PATENT DOCUMENTS

JP H10-078728 A 3/1998
JP 2002-116653 A 4/2002

* cited by examiner

*Primary Examiner* — Hoan H Tran
(74) *Attorney, Agent, or Firm* — Studebaker & Brackett PC

(57) ABSTRACT

A fixing device includes a fixing member, a pressuring member and a temperature sensing part. The fixing member heated by a heat source contacts with a recording medium to heat a toner image on the recording medium. The pressuring member pressures the recording medium to the fixing member. The temperature sensing part in non-contact with the fixing member includes an infrared sensing element sensing infrared rays from the fixing member and a condensing member condensing the infrared rays to the infrared sensing element. Detection temperature of the fixing member is calculated with a sensing value by the infrared sensing element. The detection temperature or control temperature of the heat source is corrected with temperature deference between the infrared sensing element and the condensing member. Heating of the fixing member is controlled with the corrected detection temperature and the control temperature or the detection temperature and the corrected control temperature.

10 Claims, 7 Drawing Sheets

FIXING DEVICE AND IMAGE FORMING APPARATUS

INCORPORATION BY REFERENCE

This application is based on and claims the benefit of priority from Japanese Patent application No. 2017-159496 filed on Aug. 22, 2017, the entire contents of which are incorporated herein by reference.

BACKGROUND

The present disclosure relates to a fixing device fixing a toner image onto a sheet and an image forming apparatus including this fixing device.

Conventionally, an image forming apparatus includes a fixing device fixing a toner image formed on a recording medium, such as a sheet. The fixing device includes a fixing member heating the toner image and a pressuring member pressuring the toner image to the recording medium, and includes a temperature sensing part, such as a thermopile, sensing temperature of the fixing member in order to control heating of the fixing member. The temperature sensing part includes an infrared sensing element sensing infrared rays radiated from the fixing member and a condensing member condensing infrared rays to the infrared sensing element, and is arranged in a non-contact state with the fixing member. On the basis of the result of sensing by the infrared sensing element, detection temperature of the fixing member is calculated.

However, if the temperature sensing part is located at a position receiving an effect of heating of the fixing member, it is feared that temperature of the fixing member is erroneously detected. For example, because the condensing member is located near external environment of the temperature sensing part and easily receives the effect of heating of the fixing member in comparison with the infrared sensing element, temperature difference between the infrared sensing element and the condensing member may occur. In a case where such difference occurs, for example, if the infrared ray from the condensing member acts on the infrared sensing element to affect the result of sensing, the detection temperature may not be accurately calculated.

Moreover, the fixing device may be configured that a condensing mirror located along a longitudinal direction of a heating roller (the fixing member) condenses an infrared radiation light as temperature information of the heating roller and a reflecting mirror reflects the temperature information of the heating roller condensed by the condensing mirror to one side in an axial direction of the heating roller. In such a fixing device, a temperature sensor (the temperature sensing part) is located at a position where temperature does not become high (i.e., a position is not affected by heating of the fixing member) to input temperature information of the heating roller reflected by the reflecting mirror.

Further, the fixing device may be configured to include a thermopile (the temperature sensing part) located in a non-contact state with a heat roller (the fixing member) and the thermopile detects temperature of the heat roller on the basis of infrared rays radiated from the heat roller. This fixing device includes a direct measuring thermistor, in separation from the thermopile, detecting temperature of the heat roller. This fixing device corrects temperature detected by the thermopile on the basis of temperature detected by the direct measuring thermistor.

In the fixing device, in order to locate the temperature sensing part sensing temperature of the fixing member at the position not affected by heating of the fixing member, as mentioned above, it is necessary to provide a transmitting member, such as the condensing mirror and the reflecting mirror. Therefore, in comparison with a device not including the transmitting member and a mounting mechanism for the transmitting member, the number of components and component cost are increased, and then, enlargement and complication of the device are incurred in order to secure a mounting space for the transmitting member.

In addition, in order to correct detection temperature of a non-contact type temperature sensing part, such as a thermopile, in a case where other contact type temperature sensing part, such as a direct measuring thermistor, is arranged as mentioned above, cost may be increased in comparison with a device without the other contact type temperature sensing part and a mounting mechanism for the other contact type temperature sensing part.

SUMMARY

In accordance with an embodiment of the present disclosure, a fixing device includes a fixing member, a pressuring member and a temperature sensing part. The fixing member is configured to be heated by a heat source, to come into contact with a recording medium on which a toner image is formed, and to heat the toner image. The pressuring member is configured to pressure the recording medium passing between the fixing member and the pressuring member. The temperature sensing part is arranged in a non-contact state with the fixing member, and configured to include an infrared sensing element sensing infrared rays radiated from the fixing member and a condensing member condensing the infrared rays to the infrared sensing element. In the fixing device, detection temperature of the fixing member is calculated on the basis of a sensing value by the infrared sensing element. The detection temperature or control temperature of the heat source is corrected on the basis of temperature deference between the infrared sensing element and the condensing member. Heating of the fixing member is controlled on the basis of the corrected detection temperature and the control temperature or the detection temperature and the corrected control temperature.

In accordance with an embodiment of the present disclosure, an image forming apparatus includes the above-described fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
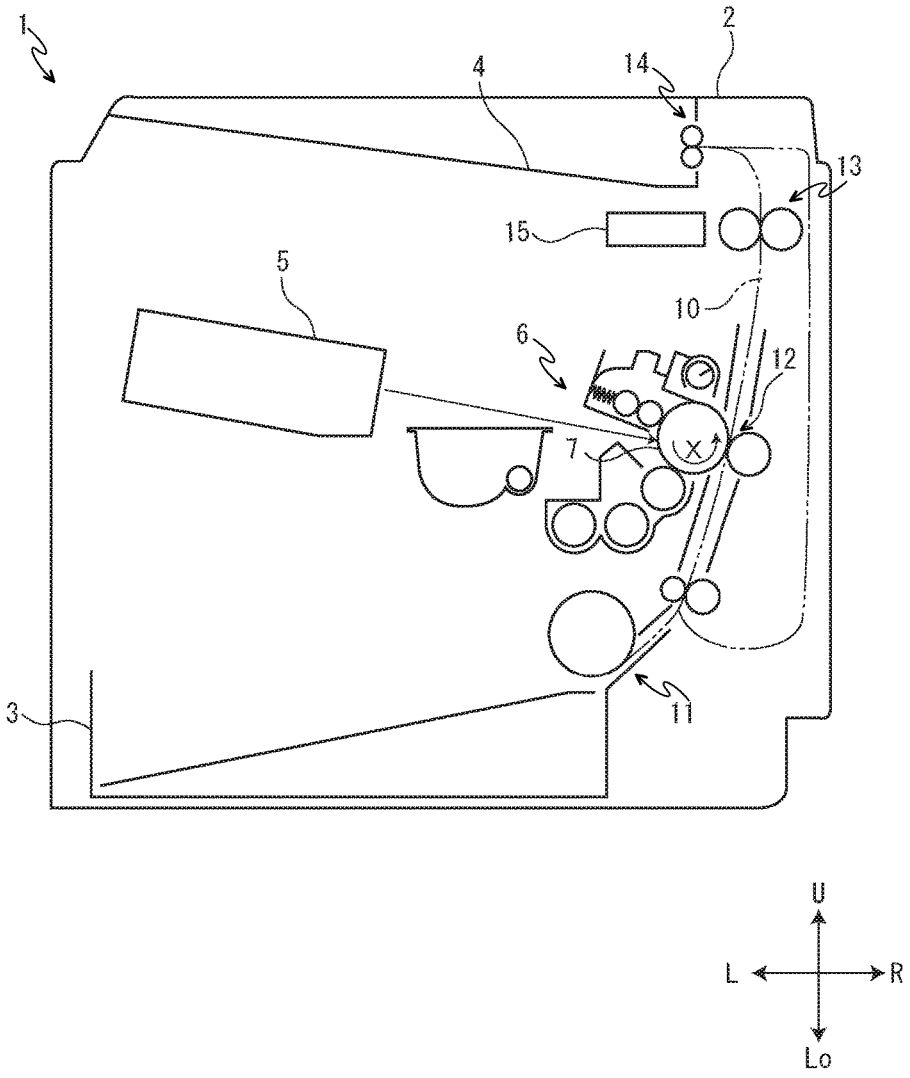
FIG. 1 is a sectional view showing a printer according to an embodiment of the present disclosure.

First, the entire structure of a printer 1 (an image forming apparatus) according to an embodiment of the present disclosure will be described with reference to FIG. 1. In the embodiment, for convenience sake, it will be described so that the front side of the printer 1 is positioned at a near side on a paper sheet of FIG. 1. Arrows L, R, U and Lo in each of the drawings respectively indicate a left side, a right side, an upper side and a lower side of the printer 1.

The printer 1 includes a box-like formed printer body 2. In a lower part of the printer body 2, a sheet feeding cartridge 3 storing sheets (recording mediums) is installed. In an upper part of the printer body 2, an ejected sheet tray 4 is formed.

Inside the printer body 2, an exposing device 5 composed of a laser scanning unit (LSU) is located at a left side. Inside the printer body 2, an image forming part 6 is arranged at a right side. In the image forming part 6, the photosensitive drum 7 as an image carrier is rotatably arranged. Around the photosensitive drum 7, a charging device, a developing device connected to a toner container, a transferring roller and a cleaning device are located along a rotating direction of the photosensitive drum 7.

In a right part inside the printer body 2, a conveying path 10 for the sheet is arranged from a lower side to an upper side. At an upstream end of the conveying path 10, a sheet feeding part 11 is positioned near the sheet feeding cartridge 3. At an intermediate stream part of the conveying path 10, a transferring part composed of the photosensitive drum 7 and the transferring roller is positioned. At a downstream part of the conveying path 10, a fixing device 13 is positioned. At a downstream end of the conveying path 10, a sheet ejecting part 14 is positioned near the ejected sheet tray 4. Moreover, inside the printer body 2, a controller 15 controlling fixing process of the fixing device 13 is provided.

Next, image forming operation of the printer 1 including such configuration will be described. In the printer 1, when image data is inputted and a printing start is directed from an external computer or the like connected with the printer 1, image forming operation is started. First, in the image forming part 6, the surface of the photosensitive drum 7 is electrically charged by the charging device, and then, is exposed on the basis of the image data by a laser light from the exposing device 5, thereby forming an electrostatic latent image on the surface of the photosensitive drum 7. Subsequently, the electrostatic latent image is developed to a toner image by the developing device using toner in the image forming part 6.

On the other hand, the sheet stored in the sheet feeding cartridge 3 is picked up by the sheet feeding part 11 and conveyed on the conveying path 10. The sheet on the conveying path 10 is conveyed to the transferring part 12 in a given timing and, in the transferring part 12, the toner image on the photosensitive drum 7 is transferred onto the sheet. The sheet with the transferred toner image is conveyed to the fixing device 13 and, in the fixing device 13, the toner image is fixed on the sheet. The sheet with the fixed toner image is ejected from the sheet ejecting part 14 to the sheet ejected tray 4.

Figure 2:
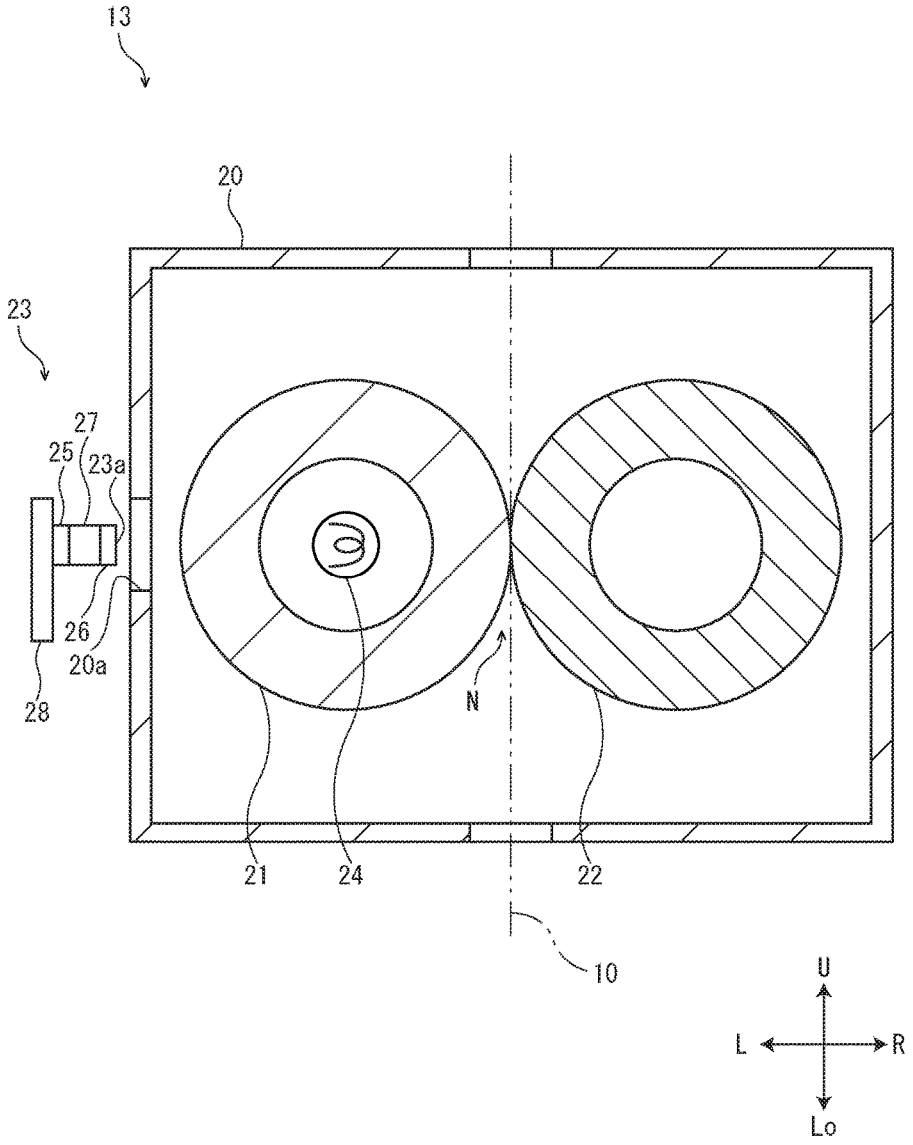
FIG. 2 is a sectional view showing a fixing device of the printer according to the embodiment of the present disclosure.

Next, the fixing device 13 will be described with reference to FIG. 2. As shown in FIG. 2, the fixing device 13 includes a frame 20, a fixing roller 21 (a fixing member), a pressuring roller 22 (a pressuring member) and a temperature sensing part 23.

The frame 20 is formed in a box-like shape. The frame 20 includes an inlet port for the sheet at a lower side and an outlet port for the sheet at an upper side. The frame 20 is attached to the printer body 2 so that the conveying path 10 penetrates through the frame 20 to pass through the inlet port and the outlet port. In the frame 20, the fixing roller 21 and the pressuring roller 22 are respectively positioned at a left side and a right side across the conveying path 10. In a left face (a face at a side of the fixing roller 21) of the frame 20, a temperature sensing hole 20*a* is opened.

The fixing roller 21 is formed in a roughly columnar shape elongated in forward and backward directions, has a rotation axis elongated in the forward and backward directions, and is rotatably supported by the frame 20. The fixing roller 21 is composed of, for example, a cylindrical core material made of aluminum or other metal, an elastic layer made of silicone rubber or the like provided around the core material, and a release layer made of PFA or other fluororesin coating the elastic layer. The core material is connected with a drive source (refer to FIG. 3), such as a motor, via a driving gear (not shown), and then, the fixing roller 21 is rotated by rotation driving force from the drive source 32.

Inside the fixing roller 21, a heat source 24 is arranged. The heat source 24 is composed of, for example, a halogen heater, a ceramic heater or the like, and generates heat by energization to heat the fixing roller 21. The fixing roller 21 comes into contact with the sheet having the toner image to heat the toner image.

The pressuring roller 22 is formed in a columnar shape elongated in the forward and backward directions, has a rotation axis elongated in the forward and backward directions, and is rotatably supported by the frame 20. The pressuring roller 22 is composed of, for example, a cylindrical core material made of aluminum, iron or other metal, an elastic layer made of silicone rubber or the like provided around the core material, and a release layer made of PFA or other fluororesin coating the elastic layer. The pressuring roller 22 is pressured to a side of the fixing roller 21 to form a fixing nip N between the fixing roller 21 and the pressuring roller 22. The pressuring roller 22 pressures the sheet passing the fixing nip N together with the fixing roller 21 while rotating by following rotation of the fixing roller 21.

The temperature sensing part 23 is attached to the temperature sensing hole 20*a* of the frame 20 so that a sensing face 23*a* of the temperature sensing part 23 faces to a side of the fixing roller 21. The temperature sensing part 23 is arranged in a non-contact state with the fixing roller 21. The temperature sensing part 23 includes, for example, an infrared sensing element 25, a condensing member 26, a tube-like case 27 and a substrate 28. The infrared sensing element 25 is composed of, for example, a thermopile to sense infrared rays radiated from the fixing roller 21. The condensing member 26 is composed of, for example, a lens to condense the infrared rays radiated from the fixing roller 21 into the infrared sensing element 25. The infrared sensing element 25 is attached inside the case 27 at an opposite side to the sensing face 23*a* and the condensing member 26 is attached inside the case 27 at a side of the sensing face 23*a*. The case 27 is attached to the substrate 28 and the infrared sensing element 25 is electrically connected with the substrate 28. Subsequently, the temperature sensing part outputs an electric signal indicating the result of sensing of the infrared rays by the infrared sensing element 25 as a signal corresponding to surface temperature of the fixing roller 21.

Figure 3:
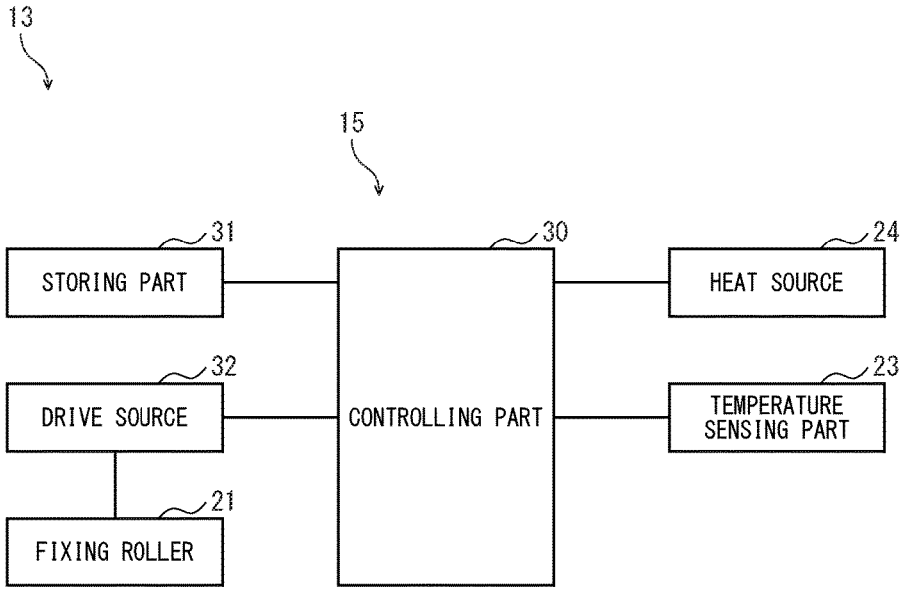
FIG. 3 is a block diagram showing electric structure of the fixing device of the printer according to the embodiment of the present disclosure.

Next, structure of the controller 15 will be described with reference to FIGS. 3-6. As shown in FIG. 3, the controller 15 includes a controlling part 30 composed of CPU and others and a storing part 31 composed of ROM, RAM and others. The controller 15 may be provided in the fixing device 13, or alternatively, a main controller (not shown) integratedly controlling the printer 1 may act as the controller 15.

The controller 15 is connected with the temperature sensing part 23, the heat source 24 heating the fixing roller 21, the drive source 32 rotating the fixing roller 21 and other components of the fixing device 13. The storing part 31 stores programs and data for actualizing a fixing process function, such as a fixing temperature control function, of the fixing device 13. The controller 15 controls components connected with the controller 15 by executing operation process in the controlling part 30 in accordance with program and others stored in the storing part 31.

For example, as the fixing temperature control function of the fixing device 13, the controller 15 inputs a sensing value by the temperature sensing part 23 (the infrared sensing element 25) and calculates detection temperature of the surface of the fixing roller 21 on the basis of the sensing value. Moreover, the controller 15 sets control temperature (threshold) of the heat source 24 heating the fixing roller 21 on the basis of desired fixing temperature (ideal temperature as target temperature). Subsequently, the controller 15 controls the heat source 24 on the basis of the detection temperature of the fixing roller 21 and the control temperature of the heat source 24. For example, in a case where the detection temperature is lower than the control temperature, the controller 15 executes energization to the heat source 24 to execute heating. On the other hand, in another case where the detection temperature is equal to or higher than the control temperature, the controller 15 interrupts energization to the heat source 24 to stop heating. Thereby, the controller 15 controls the heat source 24 so that the detection temperature becomes equal to the control temperature, and accordingly, actual surface temperature (actual temperature) of the fixing roller 21 is controlled so as to become equal to the desired fixing temperature (the ideal temperature). Correction of the detection temperature and the control temperature by the controller 15 will be described later.

In the storing part 31, a correction amount table is stored as a way of acquiring a correction amount T3 used for correcting the detection temperature of the fixing roller 21 and a correction amount T4 used for correcting the control temperature of the heat source 24. In the correction amount table, the correction amount T3 and the correction amount T4, and temperature difference between temperature T1 of the infrared sensing element 25 itself and temperature T2 of the condensing member 26 itself in the temperature sensing part 23 are set while being associated with heating time (driving time) of the fixing roller 21. The temperature T1 of the infrared sensing element 25 and the temperature T2 of the condensing member 26 are measured for each of various heating times of the fixing roller 21 in advance, the detection temperature and the actual temperature of the fixing roller 21 are measured in advance, and the correction amount T3 and the correction amount T4 are calculated (backwards) on the basis of the detection temperature and the actual temperature in advance, and accordingly, the correction amount table is made and stored in the storing part 31 in advance.

Figure 4:
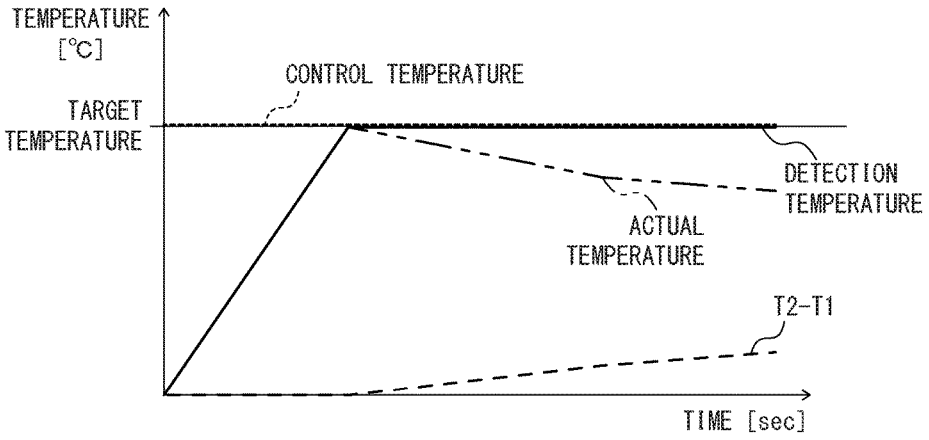
FIG. 4 is a graph plotting relationship of actual temperature and detection temperature of a fixing roller, control temperature of a heat source, and temperature difference between an infrared sensing element and a condensing member of a temperature sensing part, in the fixing device of the printer according to the embodiment of the present disclosure.

Hereinafter, relationship among the correction amount T3 of the detection temperature of the fixing roller 21 and the correction amount T4 of the control temperature of the heat source 24, the temperature T1 of the infrared sensing element 25 and the temperature T2 of the condensing member 26 in the temperature sensing part 23, and the heating time of the fixing roller 21 will be described with reference to FIGS. 4-6.

The detection temperature of the fixing roller 21 calculated on the basis of the sensing value by the temperature sensing part 23 (the infrared sensing element 25) is generally estimated as the actual temperature of the fixing roller 21. However, as a first example, when the temperature sensing part 23 is heated according to the lapse of the heating time of the fixing roller 21 since start of heating of the fixing roller 21, and then, temperature of the temperature sensing part 23 reaches predetermined temperature, as shown in FIGS. 4-6, the temperature T2 of the condensing member 26 itself may become higher than the temperature T1 of the infrared sensing element 25 itself depending on location and individuality of the temperature sensing part 23. In such a case, because the infrared sensing element 25 receives infrared rays from the condensing member 26 in addition to infrared rays from the fixing roller 21, the sensing value by the temperature sensing part 23 is increased. Therefore, if the detection temperature of the fixing roller 21 calculated on the basis of the sensing value by the temperature sensing part 23 is not corrected, due to temperature difference T2>T1 of the temperature sensing part 23, the detection temperature is not appropriately estimated and becomes higher than the actual temperature of the fixing roller 21.

Moreover, the control temperature of the heat source 24 is generally set to a value equal to the ideal temperature of the fixing roller 21. As described above, heating of the heat source 24 is executed in a case where the detection temperature of the fixing roller 21 is lower than the control temperature, while stopped in another case where the detection temperature is equal to or higher than the control temperature. In the first example, regardless of the actual temperature of the fixing roller lower than the ideal temperature, the detection temperature of the fixing roller 21 may be detected higher than the actual temperature due to the temperature difference T2>T1 of the temperature sensing part 23 and reach the ideal temperature. In such a case, if the control temperature is not corrected, because the detection temperature becomes equal to or higher than the control temperature set equal to the ideal temperature, heating of the heat source 24 may be stopped and the actual temperature of the fixing roller 21 may not reach the ideal temperature. On other words, when the detection temperature becomes high due to the temperature difference T2>T1 of the temperature sensing part 23, as shown in FIG. 4, if the control temperature is not corrected, the control temperature is set lower than temperature to be set for comparison with the detection temperature.

Figure 5:
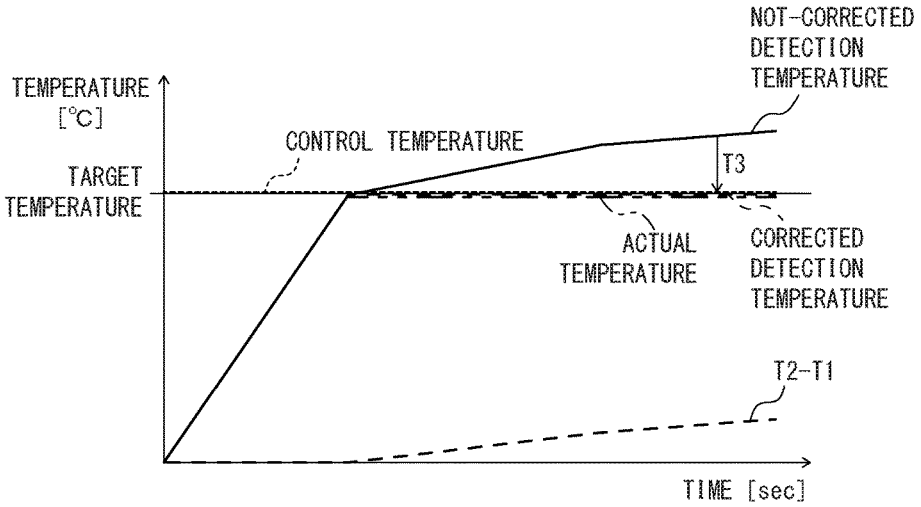
FIG. 5 is a graph plotting relationship of actual temperature and corrected detection temperature of the fixing roller, control temperature of the heat source, and temperature difference between the infrared sensing element and the condensing member of the temperature sensing part, in the fixing device of the printer according to the embodiment of the present disclosure.
Figure 6:
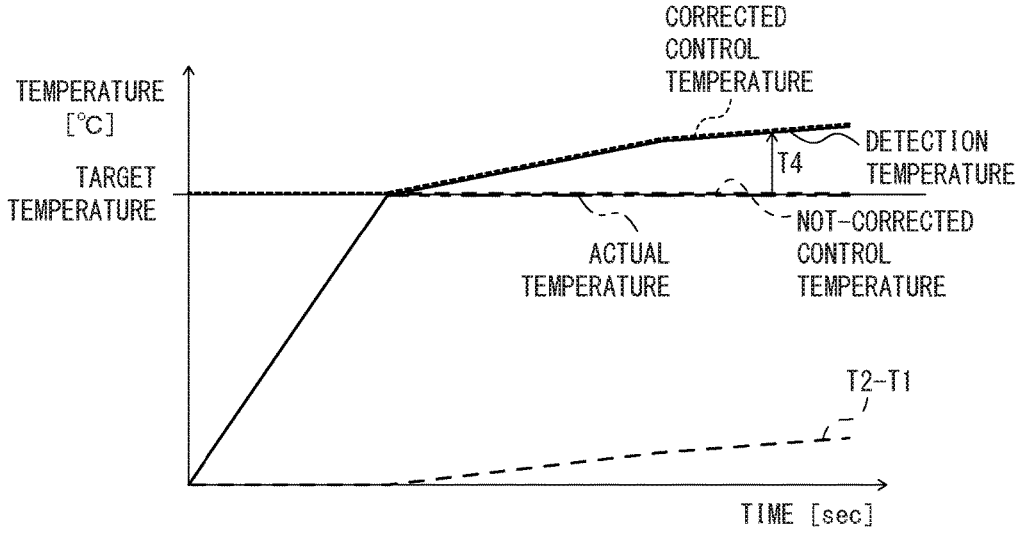
FIG. 6 is a graph plotting relationship of actual temperature and detection temperature of the fixing roller, corrected control temperature of the heat source, and temperature difference between the infrared sensing element and the condensing member of the temperature sensing part, in the fixing device of the printer according to the embodiment of the present disclosure.

Thereupon, in the correction amount table of the first example, as the temperature T2 of the condensing member 26 is higher than the temperature T1 of the infrared sensing element 25 (T1<T2), as shown in FIG. 5, the correction amount T3 (T3<0) for lowering the detection temperature of the fixing roller 21 is set, or alternatively, as shown in FIG. 6, the correction amount (T4>0) for heightening the control temperature of the heat source 24 is set. Incidentally, because the correction amount T3 and the correction amount T4 depend on location and individuality of the temperature sensing part 23, the correction amount T3 and the correction amount T4 are preferably calculated when the printer 1 is shipped from a factory or installed. For example, an absolute value (variation) of the correction amount T3 may be increased according to increase of temperature difference of T2−T1, and inclination of increase of the absolute value of the correction amount T3 may be constant or be increased or decreased according to increase of temperature difference of T2−T1. Moreover, upper limit values for the integrated correction amount T3 and the integrated correction amount T4 may be set.

Further, as a second example, when the temperature sensing part 23 is heated according to the lapse of the heating time of the fixing roller 21 since start of heating of the fixing roller 21, and then, temperature of the temperature sensing part 23 reaches predetermined temperature, contrary to the first example, the temperature T2 of the condensing member 26 itself may become lower than the temperature T1 of the infrared sensing element 25 itself depending on location and individuality of the temperature sensing part 23. In such a case, because the condensing member 26 absorbs infrared rays from the fixing roller 21 and thereby infrared rays from the fixing roller 21 receiving by the infrared sensing element 25 is decreased, the sensing value by the temperature sensing part 23 is decreased. For example, the temperature sensing part 23 has individuality so that graphs after reaching target temperature in FIGS. 4-6 are re-plotted upside down with respect to a line of target temperature. Therefore, if the detection temperature of the fixing roller 21 calculated on the basis of the sensing value by the temperature sensing part 23 is not corrected, due to temperature difference T2<T1 of the temperature sensing part 23, the detection temperature is not appropriately estimated and becomes lower than the actual temperature of the fixing roller 21.

In the second example, contrary to the first example, regardless of the actual temperature of the fixing roller 21 higher than the ideal temperature, the detection temperature of the fixing roller 21 may be detected lower than the actual temperature due to the temperature difference T2<T1 of the temperature sensing part 23 and not reach the ideal temperature. In such a case, if the control temperature is not corrected, because the detection temperature becomes lower than the control temperature set equal to the ideal temperature, heating of the heat source 24 may be continued and the actual temperature of the fixing roller 21 may exceed the ideal temperature. On other words, when the detection temperature becomes low due to the temperature difference T2<T1 of the temperature sensing part 23, if the control temperature is not corrected, the control temperature is set higher than temperature to be set for comparison with the detection temperature.

Thereupon, in the correction amount table of the second example, contrary to the first example, as the temperature T2 of the condensing member 26 is lower than the temperature T1 of the infrared sensing element 25, the correction amount T3 (T3>0) for heightening the detection temperature of the fixing roller 21 is set, or alternatively, the correction amount T4 (T4<0) for lowering the control temperature of the heat source 24 is set. Incidentally, because the correction amount T3 and the correction amount T4 depend on location and individuality of the temperature sensing part 23, the correction amount T3 and the correction amount T4 are preferably calculated when the printer 1 is shipped from a factory or installed. For example, an absolute value (variation) of the correction amount T3 may be increased according to increase of temperature difference of T1−T2, and inclination of increase of the absolute value of the correction amount T3 may be constant or be increased or decreased according to increase of temperature difference of T1−T2. Moreover, upper limit values for the integrated correction amount T3 and the integrated correction amount 14 may be set.

In both cases of the first example and the second example, when the temperature T1 of the infrared sensing element 25 and temperature T2 of the condensing member 26 are equal to each other (T1=T2), the correction amount T3 and the correction amount T4 may be set to zero (T3=0, T4=0), or alternatively, the detection temperature and the control temperature may be not corrected.

In both cases of the first example and the second example, the temperature sensing part 23 is configured so that temperature difference of T2−T1 (or T1−T2) between the infrared sensing element 25 and the condensing member 26 becomes zero at the time when the actual temperature of the fixing roller 21 reaches the ideal temperature. Subsequently, after the actual temperature of the fixing roller 21 reaches the ideal temperature, temperature difference between the infrared sensing element 25 and the condensing member 26 becomes T2>T1 (or T1>T2). For example, after the actual temperature of the fixing roller 21 reaches the ideal temperature, temperature difference between the infrared sensing element 25 and the condensing member 26 is gradually increased according to the lapse of the heating time, inclination of increase of temperature difference becomes gradually gentle, and then, temperature difference converges to a predetermined value. Thereupon, the absolute values of the correction amount T3 and the correction amount T4 may be set so as to be increased according to the lapse of the heating time, provided that increase of the absolute value becomes relatively gentle as the heating time is lapsed, and then, to finally converge to a predetermined value. Incidentally, before the actual temperature of the fixing roller 21 reaches the ideal temperature, not illustrated, temperature difference between the infrared sensing element 25 and the condensing member 26 is T2<T1 (or T1<T2) and gradually approaches T2=T1. However, because the temperature difference does not affect temperature control of the fixing roller 21, the correction amount T4 may be set to zero, or alternatively, the detection temperature and the control temperature may be not corrected.

When the printer 1 is shipped from a factory or installed, location and individuality of the temperature sensing part 23 are measured, that is, it is decided whether the temperature difference of the temperature sensing part 23 becomes T2>T1 or T2<T1 according to heating of the fixing roller 21. Subsequently, if the temperature difference of the temperature sensing part 23 is decided as T2>T1, the correction amount table of the first example as described above is set, or alternatively, if the temperature difference of the temperature sensing part 23 is decided as T2<T1, the correction amount table of the second example as described above is set.

Next, heating control operation of the fixing roller 21 with correcting the detection temperature of the fixing roller 21 as the fixing temperature control function of the fixing device 13 will be described with reference to a flowchart of FIG. 7.

Figure 7:
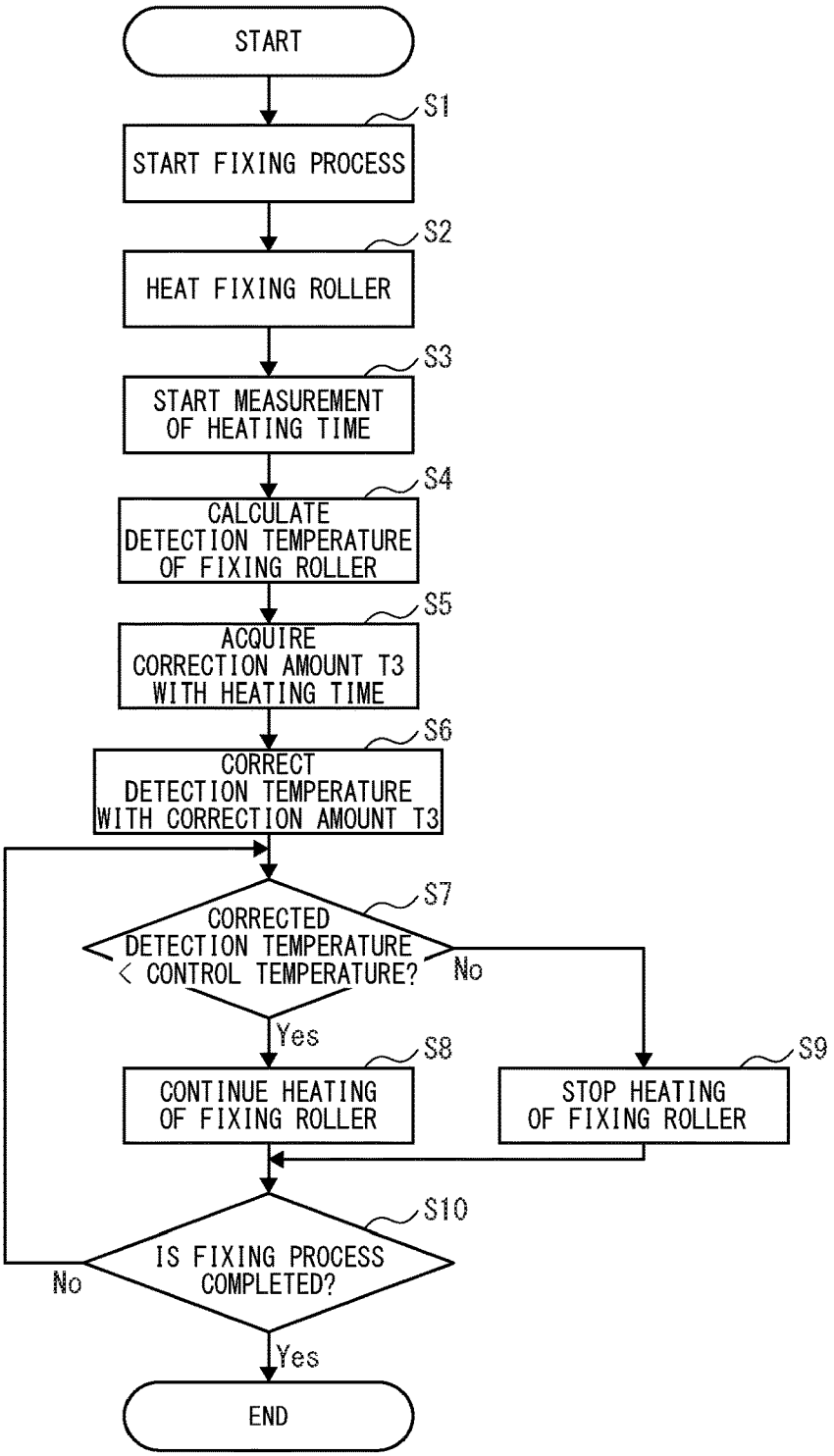
FIG. 7 is a flowchart showing heating control operation of the fixing roller with correction of detection temperature of the fixing roller, in the fixing device of the printer according to the embodiment of the present disclosure.

As shown in FIG. 7, when the printer 1 executes the image forming operation as described above and the fixing device 13 starts the fixing process (step S1), energization to the heat source 24 is executed and heating of the fixing roller 21 is started (step S2). Incidentally, the controller 15 sets the ideal temperature of the fixing roller 21 to an initial value of the control temperature of the heat source 24.

The controller 15 starts measurement of the heating time from heating start of the fixing roller 21 (step S3). Moreover, the controller 15 controls the temperature sensing part 23 to sense infrared rays from the fixing roller 21 for each predetermined time, inputs the result of sensing, and calculates the detection temperature of the fixing roller 21 on the basis of a sensing value as the result (step S4).

Then, the controller 15 refers the correction amount table stored in the storing part 31, on the basis of the heating time of the fixing roller 21, to grasp the temperature difference between the temperature T1 of the infrared sensing element 25 and the temperature T2 of the condensing member 26 and to acquire the correction amount T3 of the detection temperature (step S5), and corrects the detection temperature by using the correction amount T3 (step S6).

Subsequently, the controller 15 compares the corrected detection temperature of the fixing roller 21 with the control temperature of the heat source 24 (step S7). As a result, if the corrected detection temperature is less than the control temperature (step S7: Yes), the controller 15 continues energization to the heat source 24 and continues heating of the fixing roller 21 (step S8). On the other hand, if the corrected detection temperature is equal to or more than the control temperature (step S7: No), the controller 15 interrupts energization to the heat source 24 and stops heating of the fixing roller 21 (step S9). Incidentally, correction of the detection temperature may be started after the detection temperature of the fixing roller 21 first reaches the control temperature.

Control of the heat source 24 on the basis of comparison of the corrected detection temperature and the control temperature as described above is continued during the fixing process (step S10: No) and is executed each time the controller 15 calculates the detection temperature of the fixing roller 21. On the other hand, such control is completed by completion of the fixing process (step S10: Yes).

Figure 8:
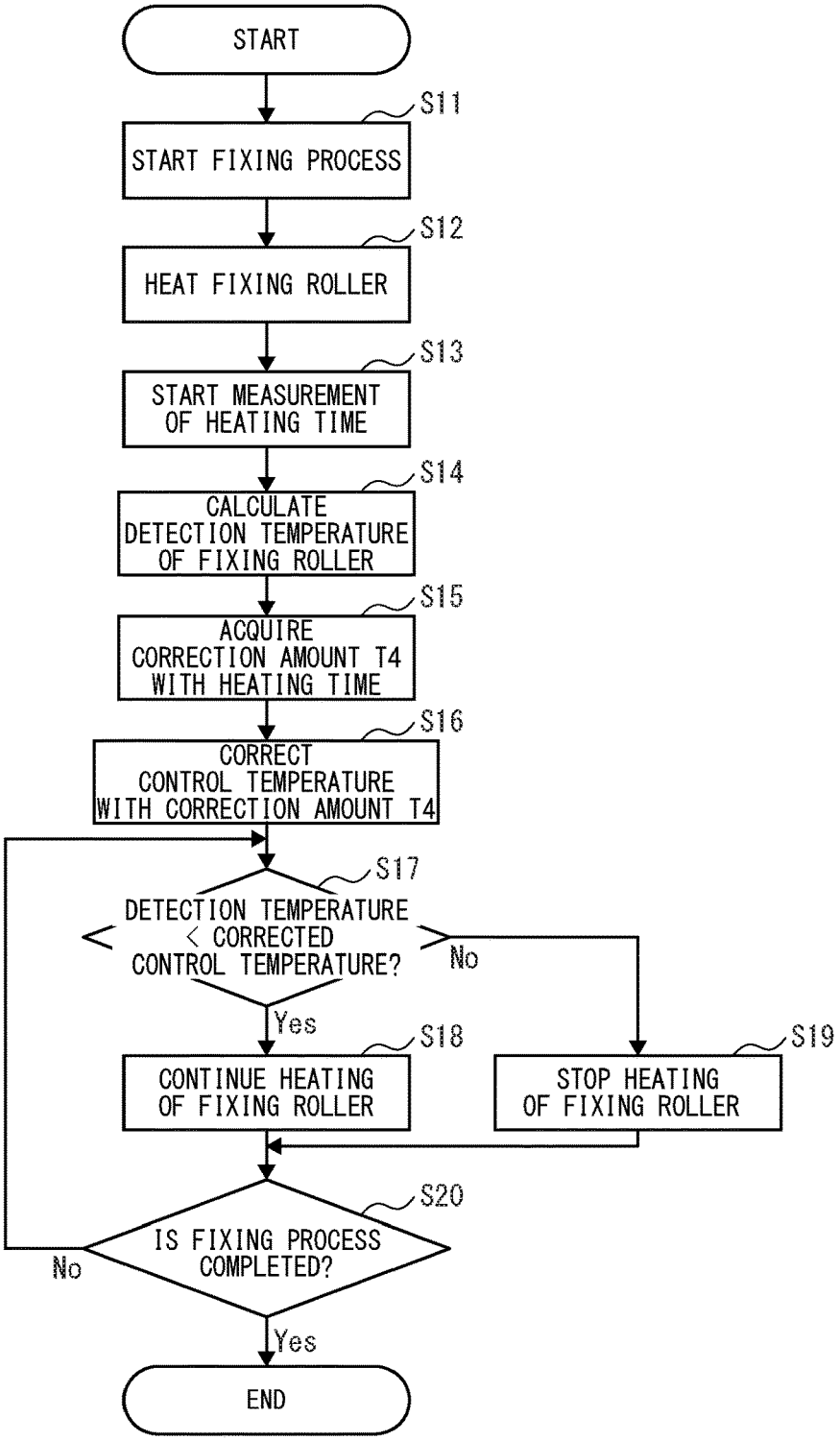
FIG. 8 is a flowchart showing heating control operation of the fixing roller with correction of control temperature of the heat source, in the fixing device of the printer according to the embodiment of the present disclosure.

Next, heating control operation of the fixing roller 21 with correcting the control temperature of the heat source 24 as the fixing temperature control function of the fixing device 13 will be described with reference to a flowchart of FIG. 8. In this operation, operation to calculation of the detection temperature of the fixing roller 21 (steps S11-S14) is similar to steps S1-S4 of correction operation of the detection temperature of the fixing roller 21 as described above, and accordingly, description of steps S11-S14 is omitted.

When the controller 15 calculates the detection temperature of the fixing roller 21 (step S14), the controller 15 refers the correction amount table stored in the storing part 31 to acquire the correction amount T4 of the control temperature on the basis of the heating time of the fixing roller 21 (step S15), and corrects the control temperature by using the correction amount T4 (step S16).

Subsequently, similarly to steps S1-S4 of correction operation of the detection temperature of the fixing roller 21 as described above, the controller 15 compares the corrected control temperature of the heat source 24 with the detection temperature of the fixing roller 21 (step S17) to control the heat source 24 on the basis of the result of comparing. Incidentally, correction of the control temperature may be started after the detection temperature of the fixing roller 21 first reaches the control temperature.

In accordance with the embodiment, as described above, the fixing device 13 in the printer 1 (the image forming apparatus) includes the fixing roller 21 (the fixing member), the pressuring roller 22 (the pressuring member) and the temperature sensing part 23. The fixing roller 21 is configured to be heated by the heat source 24, to come into contact with the sheet (the recording medium) on which a toner image is formed, and to heat the toner image. The pressuring roller 22 is configured to pressure the sheet passing between the fixing roller 21 and the pressuring roller 22. The temperature sensing part 23 is arranged in a non-contact state with the fixing roller 21, and configured to include the infrared sensing element 25 sensing infrared rays radiated from the fixing roller 21 and the condensing member 26 condensing the infrared rays to the infrared sensing element 25. In the fixing device 13, for example, by the controller 15, the detection temperature of the fixing roller 21 is calculated on the basis of a sensing value by the infrared sensing element 25, the detection temperature of the fixing roller 21 or the control temperature of the heat source 24 is corrected on the basis of the temperature deference between the infrared sensing element 25 and the condensing member 26, heating of the fixing roller 21 is controlled on the basis of the corrected detection temperature and the control temperature or the detection temperature and the corrected control temperature.

According to such a configuration, even if the temperature difference between the infrared sensing element 25 and the condensing member 26 of the temperature sensing part 23 occurs, heating of the fixing roller 21 is controlled on the basis of the appropriately corrected detection temperature of the fixing roller 21 or the appropriately corrected control temperature of the heat source 24. Therefore, since, regardless of whether or not location of the temperature sensing part 23 is a position affected by heating of the fixing roller 21, the detection temperature or the control temperature is acquired according to individuality of the temperature sensing part 23, it is possible to improve detection accuracy of temperature of the fixing roller 21 by the temperature sensing part 23 and to accurately control heating of the fixing roller 21. Incidentally, since it is necessary to locate the temperature sensing part 23 far from the fixing roller 21, it is necessary to provide a transmitting member, such as a mirror, transmitting radiation from the fixing roller 21 to the temperature sensing part 23 and a mounting mechanism for the transmitting member. Therefore, in comparison with a device including the transmitting member for radiation and the mounting mechanism for the transmitting member, it is possible to restrain the number of components and component cost, and to design miniaturization and simplification of the fixing device 13.

In addition, in accordance with the embodiment, in the fixing device 13, relationship between the heating time of the fixing roller 21 and the temperature deference between the infrared sensing element 25 and the condensing member 26 is stored in the storing part 31 in advance, and when heating of the fixing roller 21 is controlled, the detection temperature or the control temperature is corrected on the basis of the temperature deference corresponding to the heating time of the fixing roller 21.

Thereby, since it is necessary to provide a sensor sensing temperature of the infrared sensing element 25 and the condensing member 26 of the temperature sensing part 23 for each individual fixing device 13, it is possible to restrain the number of components and component cost, and to design miniaturization and simplification of the fixing device 13.

Incidentally, although, in the above-described embodiment, a configuration that the temperature deference between the infrared sensing element 25 and the condensing member 26 is estimated on the basis of the heating time of the fixing roller 21, and the detection temperature of the fixing roller 21 or the control temperature of the heat source 24 is corrected on the basis of the result of estimating was described, the present disclosure is not restricted by such configuration. For example, in another embodiment, the fixing device 13 may estimate the temperature deference between the infrared sensing element 25 and the condensing member 26 on the basis of the number of prints or an interval of prints.

The temperature deference between the infrared sensing element 25 and the condensing member 26 is affected by an air blow to the temperature sensing part 23 and its periphery and by variation of environment condition (e.g. temperature or humidity) of the temperature sensing part 23 and its periphery. Thereupon, the controller 15 may estimate the temperature deference between the infrared sensing element 25 and the condensing member 26 on the basis of a controlling state of an air blow controlling part (not shown) controlling the air blow or the result of sensing by an environment sensor (not shown) sensing the environment condition. For example, in a case where the temperature deference between the infrared sensing element 25 and the condensing member 26 is $T2>T1$ after heating of the fixing roller 21 is started, if the air blow is started, the temperature T2 of the condensing member 26 is lowered according to the lapse of time of the air blow and the temperature deference $T2-T1$ is decreased. Alternatively, in a case where the air blow is executed after heating of the fixing roller 21 is started, and then, the temperature deference between the infrared sensing element 25 and the condensing member 26 is $T1>T2$, if the air blow is stopped, the temperature T2 of the condensing member 26 is heightened according to the lapse of time from stop of the air blow and the temperature deference $T1-T2$ is decreased. Incidentally, relationship of the air blow and environment condition with variation of temperature of the infrared sensing element 25 and the condensing member 26 is highly diversified depending on configuration for each individual printer 1, such as location and individuality of the temperature sensing part 23 and structure of a duct of the air blow. Thereupon, it is preferable to make a table corresponding to relationship of the air blow and environment condition with variation of temperature of the infrared sensing element 25 and the condensing member 26 in advance, to bring variation of temperature from the table according to the controlling state of the air blow or the result of sensing of the environment condition, and add variation of temperature into calculation of the temperature difference between the infrared sensing element 25 and the condensing member 26.

Moreover, in accordance with the embodiment, in the fixing device 13, if temperature of the infrared sensing element 25 is equal to temperature of the condensing member 26, the detection temperature is not corrected, if temperature of the infrared sensing element 25 is less than temperature of the condensing member 26, the detection temperature is corrected to be lowered by a predetermined amount, and if temperature of the infrared sensing element 25 is more than temperature of the condensing member 26, the detection temperature is corrected to be heightened by a predetermined amount.

Thereby, it is possible to detect the temperature of the fixing roller 21 accurately adapted to individuality of the temperature sensing part 23 on the basis of the temperature difference between the infrared sensing element 25 and the condensing member 26.

Alternatively, in accordance with the embodiment, in the fixing device 13, if temperature of the infrared sensing element 25 is equal to temperature of the condensing member 26, the control temperature is not corrected, if temperature of the infrared sensing element 25 is less than temperature of the condensing member 26, the control temperature is corrected to be heightened by a predetermined amount, and if temperature of the infrared sensing element 25 is more than temperature of the condensing member 26, the control temperature is corrected to be lowered by a predetermined amount.

Thereby, it is possible to use the control temperature of the heat source 24 accurately adapted to individuality of the temperature sensing part 23 on the basis of the temperature difference between the infrared sensing element 25 and the condensing member 26.

Although, in the above-described embodiment, an example of using the correction amount table as a way of acquiring the correction amount T3 and the correction amount T4 used for correcting the detection temperature of the fixing roller 21 or the control temperature of the heat source 24 was described, the present disclosure is not restricted by such an example. For example, in another embodiment, the fixing device 13 may use numerical expressions calculating the temperature difference between the infrared sensing element 25 and the condensing member 26 on the basis of the heating time of the fixing roller and calculating the correction amount T3 and the correction amount T4 on the basis of the temperature difference, or use a numerical expression calculating the correction amount T3 and the correction amount T4 on the basis of the heating time of the fixing roller 21.

Although, in the above-described embodiment, a configuration that the fixing device 13 includes the fixing roller 21 as the fixing member was described, the fixing member is not restricted by this, but may be composed by including a fixing belt, for example.

Although, in the above-described embodiment, a configuration that the heat source 24 is composed of a halogen heater or a ceramic heater was described, the heat source 24 is not restricted by these, but may be composed of an IH coil, for example.

The embodiment was described in a case of applying the configuration of the present disclosure to the monochrome printer 1. On the other hand, in another embodiment, the configuration of the disclosure may be applied to another image forming apparatus, such as a color printer, a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A fixing device comprising:

a fixing member configured to be heated by a heat source, to come into contact with a recording medium on which a toner image is formed, and to heat the toner image;

a pressuring member configured to pressure the recording medium passing between the fixing member and the pressuring member; and a temperature sensing part arranged in a non-contact state with the fixing member, and configured to include an infrared sensing element sensing infrared rays radiated from the fixing member and a condensing member condensing the infrared rays to the infrared sensing element, wherein detection temperature of the fixing member is calculated on the basis of a sensing value by the infrared sensing element, the detection temperature or control temperature of the heat source is corrected on the basis of temperature deference between the infrared sensing element and the condensing member, heating of the fixing member is controlled on the basis of the corrected detection temperature and the control temperature or the detection temperature and the corrected control temperature.

2. The fixing device according to claim 1, wherein relationship between heating time of the fixing member and the temperature deference is stored in advance, when heating of the fixing member is controlled, the detection temperature or the control temperature is corrected on the basis of the temperature deference corresponding to the heating time of the fixing member.

3. The fixing device according to claim 2, wherein a correction amount of the detection temperature or the control temperature is set so that an absolute value is set so as to be increased according to the lapse of the heating time, provided that increase of the absolute value becomes relatively gentle as the heating time is lapsed, and then, to finally converge to a predetermined value.

4. An image forming apparatus comprising:

the fixing device according to claim 3.

5. An image forming apparatus comprising:

the fixing device according to claim 2.

6. The fixing device according to claim 1, wherein if temperature of the infrared sensing element is equal to temperature of the condensing member, the detection temperature is not corrected, if temperature of the infrared sensing element is less than temperature of the condensing member, the detection temperature is corrected to be lowered by a predetermined amount, if temperature of the infrared sensing element is more than temperature of the condensing member, the detection temperature is corrected to be heightened by a predetermined amount.

7. An image forming apparatus comprising:

the fixing device according to claim 6.

8. The fixing device according to claim 1, wherein if temperature of the infrared sensing element is equal to temperature of the condensing member, the control temperature is not corrected, if temperature of the infrared sensing element is less than temperature of the condensing member, the control temperature is corrected to be heightened by a predetermined amount, if temperature of the infrared sensing element is more than temperature of the condensing member, the control temperature is corrected to be lowered by a predetermined amount.

9. An image forming apparatus comprising:

the fixing device according to claim 8.

10. An image forming apparatus comprising:

the fixing device according to claim 1.

* * * * *